US010615544B2

(12) United States Patent
Chien et al.

(10) Patent No.: US 10,615,544 B2
(45) Date of Patent: Apr. 7, 2020

(54) PLUG ELECTRICAL CONNECTOR

(71) Applicant: Advanced Connectek Inc., New Taipei (TW)

(72) Inventors: Min-Lung Chien, New Taipei (TW); Ming-Yung Chang, New Taipei (TW); Cheng-Che Tsai, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/145,223

(22) Filed: Sep. 28, 2018

(65) Prior Publication Data

US 2019/0103711 A1 Apr. 4, 2019

(30) Foreign Application Priority Data

Oct. 2, 2017 (TW) ..... 106214679 U

(51) Int. Cl.

| | |
|---|---|
| ***H01R 13/6582*** | (2011.01) |
| ***H01R 13/50*** | (2006.01) |
| ***H01R 13/627*** | (2006.01) |
| ***H01R 13/504*** | (2006.01) |
| ***H01R 13/428*** | (2006.01) |
| ***H01R 13/6583*** | (2011.01) |
| *H01R 107/00* | (2006.01) |
| *H01R 13/6592* | (2011.01) |
| *H01R 13/6594* | (2011.01) |
| *H01R 24/60* | (2011.01) |

(52) U.S. Cl.

CPC ..... *H01R 13/6582* (2013.01); *H01R 13/428* (2013.01); *H01R 13/50* (2013.01); *H01R 13/504* (2013.01); *H01R 13/6273* (2013.01); *H01R 13/6583* (2013.01); *H01R 13/6592* (2013.01); *H01R 13/6594* (2013.01); *H01R 24/60* (2013.01); *H01R 2107/00* (2013.01)

(58) Field of Classification Search

CPC ..... H01R 12/00; H01R 13/6587; H01R 13/6594; H01R 13/6595; H01R 13/6271

USPC ..... 439/357, 607.04, 607.35, 607.37

See application file for complete search history.

(56) References Cited

U.S. PATENT DOCUMENTS

| | | | | |
|---|---|---|---|---|
| 6,786,755 | B2 * | 9/2004 | Dambach | H01R 13/6273 439/353 |
| 6,997,733 | B2 * | 2/2006 | Peng | H01R 13/6582 439/353 |
| 10,193,280 | B2 * | 1/2019 | Sutter | H01R 24/62 |
| 2010/0062642 | A1 * | 3/2010 | Zhang | H01R 13/508 439/607.41 |

(Continued)

*Primary Examiner* — Hien D Vu

(74) *Attorney, Agent, or Firm* — JCIPRNET

(57) ABSTRACT

A plug electrical connector including an insulator, a pair of side-latches, a terminal set, and a shielding shell is provided. The pair of side-latches and a plurality of terminals of the terminal set are arranged along a first axis, and each of them extends along a second axis. The pair of side-latches and the terminal set are respectively disposed in the insulator, and the pair of side-latches are located on two sides of the terminal set. The shielding shell covers the insulator along the second axis. The side-latch includes at least one protrusion exposed out of the insulator along a third axis and structurally leaning against the shielding shell, such that the shielding shell is electrically connected with the pair of side-latches. The first axis, the second axis, and the third axis are orthogonal to each other.

18 Claims, 7 Drawing Sheets

(56) References Cited

U.S. PATENT DOCUMENTS

2014/0113487 A1* 4/2014 Chen ..... H01R 13/6658
439/607.01
2018/0090892 A1* 3/2018 Little ..... H01R 24/60

* cited by examiner

PLUG ELECTRICAL CONNECTOR

CROSS-REFERENCE TO RELATED APPLICATION

This application claims the priority benefit of Taiwan patent application serial no. 106214679, filed on Oct. 2, 2017. The entirety of the above-mentioned patent application is hereby incorporated by reference herein and made a part of the specification.

BACKGROUND OF THE INVENTION

[Field of the Invention]

The invention relates to an electrical connector, and in particular, to a plug electrical connector.

[Description of Related Art]

Electrical connectors are common components in electronic devices. An electrical connector is connected with a matching electrical connector on another electronic device to serve as a signal and power transmission medium between the two electronic devices. An example of the existing electrical connectors is the Universal Serial Bus (USB) electrical connector. Currently, the USB protocol additionally includes the specification of Type C electrical connectors, which not only provide a super speed data transmission rate at 10 Gbps, but are also extensively applicable to various electronic devices (e.g., laptops) thanks to their symmetrical connector ports allowing plugging with either side up.

Due to its high-frequency transmission performance, USB Type-C has a higher requirement for the performance of electromagnetic shielding covers. Otherwise, it will cause electromagnetic interference to the surrounding equipment. Generally, taking a plug electrical connector as an example, it is usually required to dispose a shielding shell outside an insulator which accommodates elastic terminals to achieve the desired shielding effect. Moreover, as a plug electrical connector, the USB Type-C further includes a pair of side-latches configured to provide a locking force when the plug electrical connector and a receptacle electrical connector are mated with each other, such that the two can be securely locked together. However, the pair of side-latches and the shielding shell are structurally independent from each other and electrically cannot achieve collective grounding effect.

SUMMARY OF THE INVENTION

The invention provides a plug electrical connector having both electromagnetic shielding and electrical grounding effects.

A plug electrical connector of the invention includes an insulator, a pair of side-latches, a terminal set, and a shielding shell, wherein the pair of side-latches and a plurality of terminals of the terminal set are arranged along a first axis and each of them extends along a second axis. The pair of side-latches and the terminal set are respectively disposed in the insulator, and the pair of side-latches are respectively located on two sides of the terminal set. The shielding shell covers the insulator along the second axis. Each of side-latches includes at least one protrusion exposed out of the insulator along a third axis and structurally leaning against the shielding shell, such that the shielding shell is electrically connected with the side-latches. The first axis, the second axis, and the third axis are orthogonal to each other.

A plug electrical connector of the invention includes an insulator, a terminal set, a pair of pair of side-latches, and a shielding shell. The insulator has a pair of first slots and a plurality of second slots arranged along a first axis, wherein the second slots are located between the pair of first slots. The terminal set includes a plurality of terminals respectively disposed in the second slots. The pair of side-latches are respectively disposed in the first slots. The shielding shell covers the insulator along the second axis. The insulator has a pair of first notches respectively connected with the pair of first slots. The first notches expose a portion of the pair of side-latches along a third axis. The first axis, the second axis, and the third axis are orthogonal to each other.

In an embodiment of the invention, the pair of side-latches and the terminal set are respectively soldered to an electronic member, and the pair of side-latches and at least one grounding terminal of the terminal set form electrical grounding through the electronic member.

In an embodiment of the invention, each side-latch is a plate-shaped structure, and the protrusion extends from a side edge of the plate-shaped structure, wherein each side-latch has a hollow portion, such that the protrusion hangs from the side edge and is deformable along the third axis, and an extension direction of the protrusion is tilted from the third axis.

In an embodiment of the invention, a primary surface of the plate-shaped structure is parallel to a plane formed by the second axis and the third axis.

In an embodiment of the invention, the insulator has at least one slot to accommodate the side-latch, and the side-latch further includes a stop protrusion protruding from the primary surface of the plate-shaped structure and leaning against an inner wall of the slot to close the slot.

In an embodiment of the invention, the side-latch further includes an engaging structure located on the side edge, and the side-latch is assembled to the insulator through the engaging structure.

In an embodiment of the invention, the side-latch is divided into a holding segment, a leaning segment, and a locking segment along the second axis. The holding segment is assembled in the insulator. The protrusion is located on the leaning segment. The locking segment penetrates through the insulator and extends towards internal space in the insulator.

In an embodiment of the invention, the plug electrical connector is a USB type C plug electrical connector and is adapted to be connected with a receptacle electrical connector. The pair of side-latches are arranged on two opposite sides of the terminal set, and the two sides of a mid-plate of the receptacle electrical connector is adapted to be locked by the pair of side-latches to make ground connections to reduce Electromagnetic Compatibility (EMC).

In an embodiment of the invention, the plug electrical connector further includes two Electromagnetic Compatibility (EMC) shielding springs disposed outside the insulator, wherein spring portions of each shielding spring penetrate through the insulator and protrude into internal space of the insulator.

In an embodiment of the invention, the shielding spring and the pair of side-latches are an integral structure.

In an embodiment of the invention, the insulator includes a base portion and a butting portion. The butting portion extends from the base portion along the second axis. The terminal set and the pair of side-latches are assembled at the base portion and extend towards the butting portion. The pair of first notches are located on two opposite sides of the butting portion along the first axis.

In an embodiment of the invention, the insulator further includes a pair of connection portions and a pair of second notches disposed on the butting portion. The pair of connection portions are respectively located on the two opposite sides of the butting portion along the first axis. The pair of second notches are respectively located on the two opposite sides of the butting portion along the first axis. The first notches and the second notches disposed along the second axis are separated from each other by the connection portions.

In an embodiment of the invention, each of the pair of side-latches includes a holding segment and a leaning segment. The holding segment is inserted into the first slot. The leaning segment is located in the first notch and structurally leans against the shielding shell, such that the pair of side-latches are electrically connected with the shielding shell.

In an embodiment of the invention, each of the pair of side-latches includes a protrusion located on the leaning segment and exposed from the first notch along the third axis, and the protrusion structurally leans against an inner edge of the shielding shell.

In an embodiment of the invention, each of the pair of side-latches further includes a locking segment. The leaning segment is located between the holding segment and the locking segment. The pair of locking segments penetrate through the insulator and extend towards internal space in the insulator.

In an embodiment of the invention, each of the pair of side-latches further includes an engaging structure located on the holding segment. Each of the pair of side-latches is assembled to the first slot of the insulator through the engaging structure.

In an embodiment of the invention, the pair of side-latches and the terminal set are respectively soldered to an electronic member, and the pair of side-latches and at least one grounding terminal of the terminal set are electrically grounded through the electronic member.

In an embodiment of the invention, the plug electrical connector is a USB type C plug electrical connector and is adapted to be connected with a receptacle electrical connector. The pair of side-latches are arranged on two opposite sides of the terminal set, and a grounding portion of the receptacle electrical connector is adapted to be locked by the pair of side-latches to provide grounding.

In an embodiment of the invention, the plug electrical connector further includes a EMC shielding sheet disposed outside the insulator. A portion of the EMC shielding sheet penetrates through the insulator and protrudes into internal space of the insulator to lean against the receptacle electrical connector when the plug electrical connector and the receptacle electrical connector are connected with each other.

In an embodiment of the invention, the EMC shielding sheet and the pair of pair of side-latches are an integral structure, and the EMC shielding sheet is connected between the pair of side-latches.

In light of the above, by forming the notches on the insulator of the plug electrical connector of the invention, a portion of the pair of side-latches is exposed out of the insulator when the pair of side-latches penetrates through the insulator. Therefore, when the shielding shell covers the insulator, the portion of the pair of side-latches exposed out of the insulator structurally leans against an inner edge surface of the shielding shell, such that the shielding shell and the pair of side-latches can be electrically connected with each other. Such configuration allows the shielding shell and the pair of side-latches to be collectively electrically grounded, which contributes to discharging a shielding current generated on the shielding shell due to electromagnetic shielding and thereby provides a more desirable use environment of the plug electrical connector.

To provide a further understanding of the aforementioned and other features and advantages of the disclosure, exemplary embodiments, together with the reference drawings, are described in detail below.

DESCRIPTION OF THE EMBODIMENTS

Figure 1:
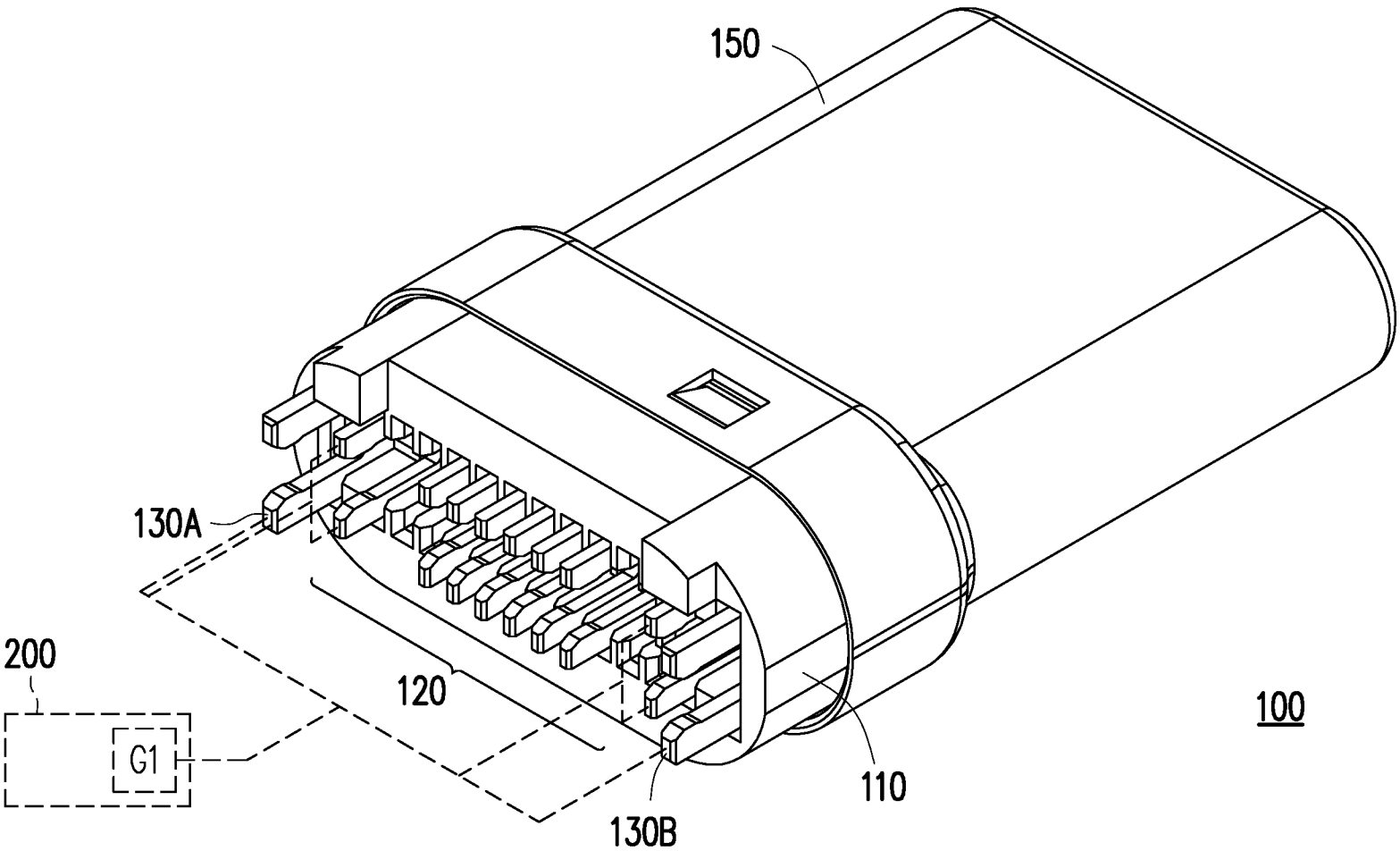
FIG. 1 is a schematic diagram illustrating a plug electrical connector according to an embodiment of the invention.
Figure 2:
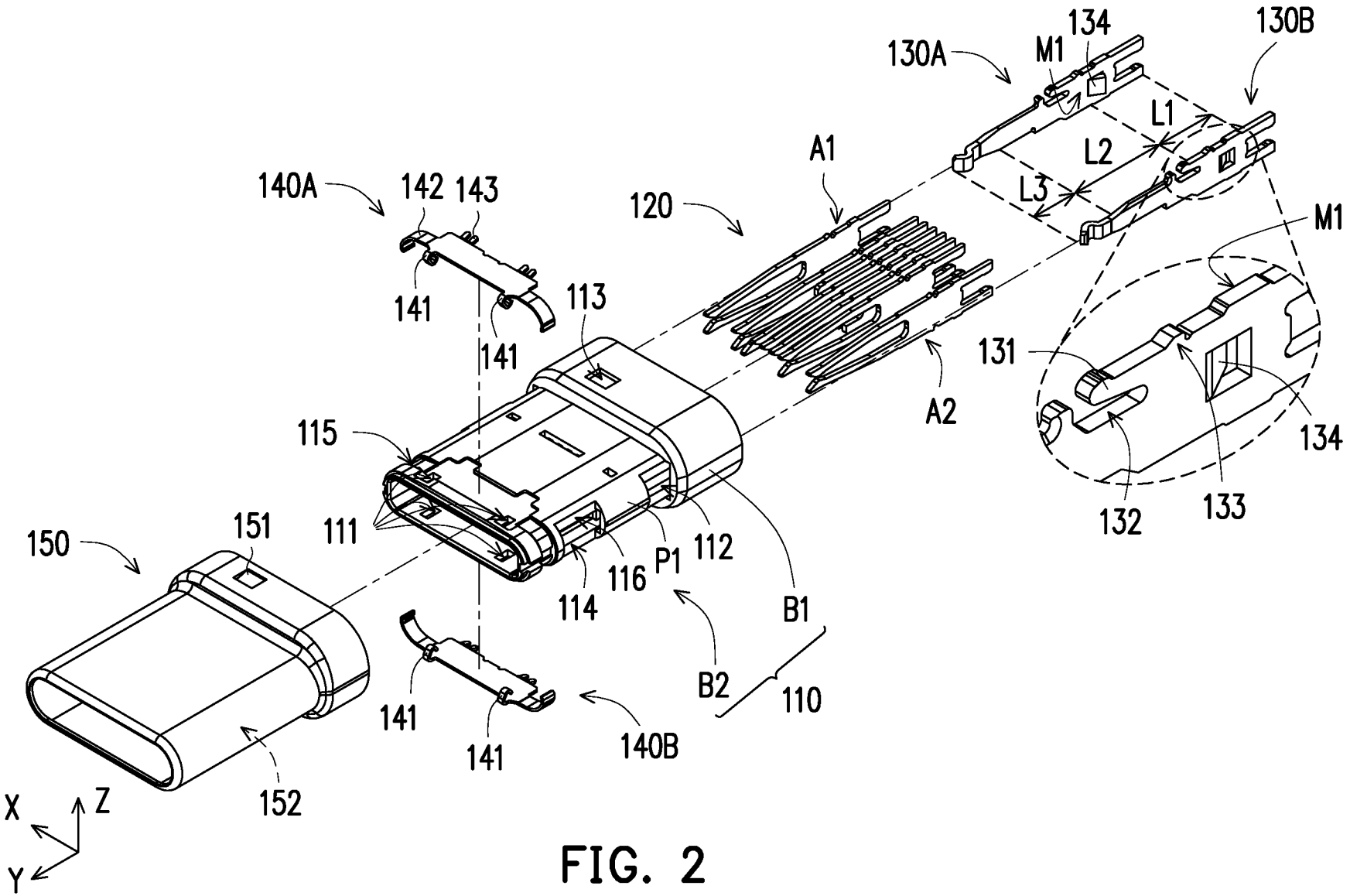
FIG. 2 is an exploded view of the plug electrical connector of FIG. 1.

FIG. 1 is a schematic diagram illustrating a plug electrical connector according to an embodiment of the invention. FIG. 2 is an exploded view of the plug electrical connector of FIG. 1. Cartesian coordinate axes X-Y-Z are also provided to facilitate description of components. Referring to both FIG. 1 and FIG. 2, in the instant embodiment, a plug electrical connector 100 includes an insulator 110, a terminal set 120, a pair of side-latches 130A and 130B, and a shielding shell 150 which is a metallic shell. The pair of side-latches and the terminal set 120 are respectively disposed inside the insulator 110. When the shielding shell 150 covers the insulator 110, a portion of each side-latch 130A (130B) is exposed out of the insulator 110 and structurally leans against the shielding shell 150, such that the side-latch 130A(130B) can be electrically connected to the shielding shell 15.

As an example, the instant embodiment provides a USB Type C plug electrical connector, including a pair of side-latches 130A, 130B respectively inserted into the insulator 110 along with the terminal set 120. Moreover, the pair of side-latches 130A, 130B are respectively arranged on two opposite sides of the terminal set 120. Specifically, the pair of side-latches 130A, 130B and terminals of the terminal set 120 are arranged along a first axis (X-axis), and each of them extends along a second axis (Y-axis). Meanwhile, since the plug electrical connector 100 of the instant embodiment is applicable to a cable, the pair of side-latches 130A, 130B and the terminals of the terminal set 120 are assembled with the insulator 110 in an upright manner.

Figure 3A:
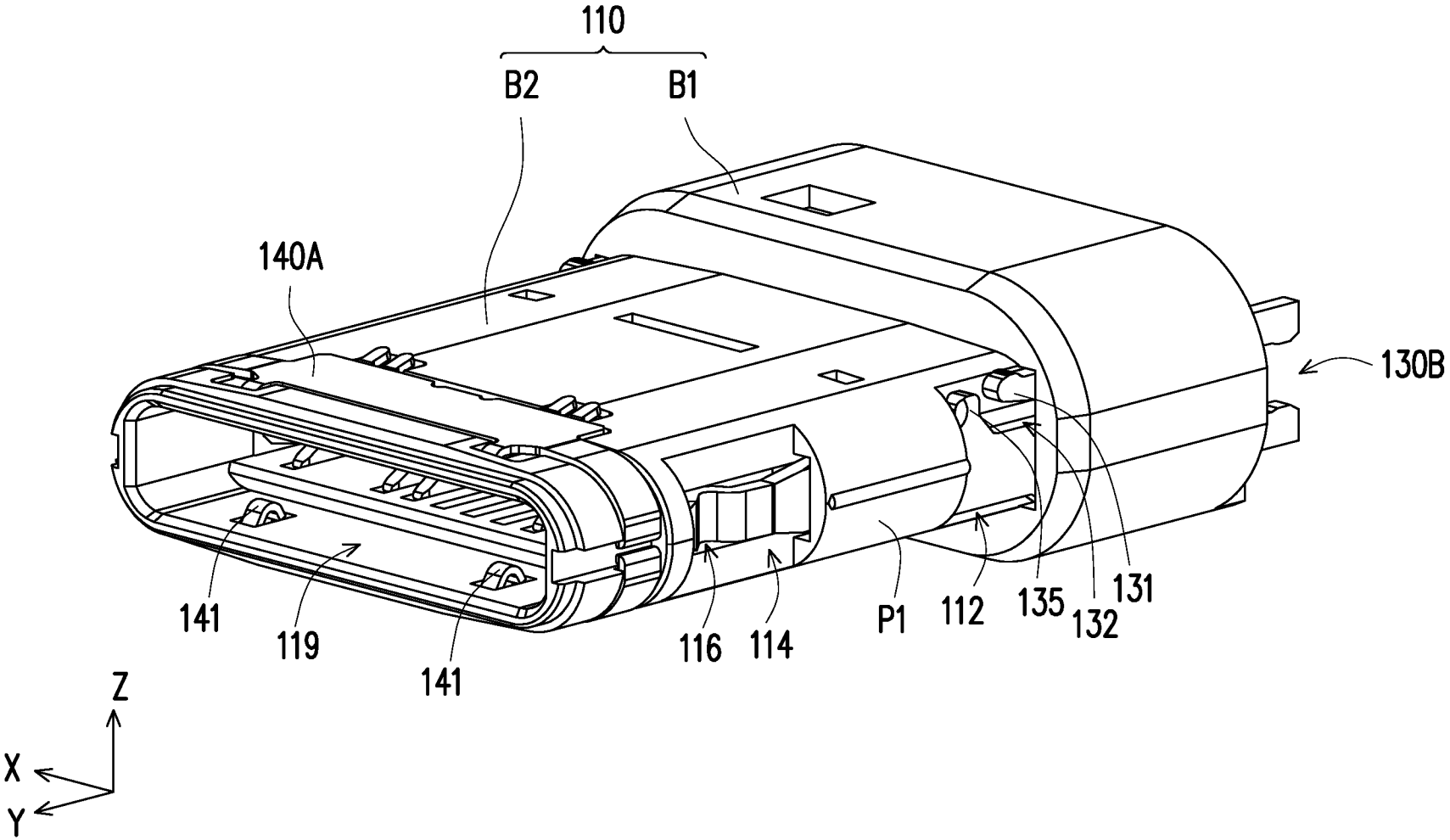
FIG. 3A is a schematic diagram illustrating part of components of the plug electrical connector of FIG. 1.
Figure 3B:
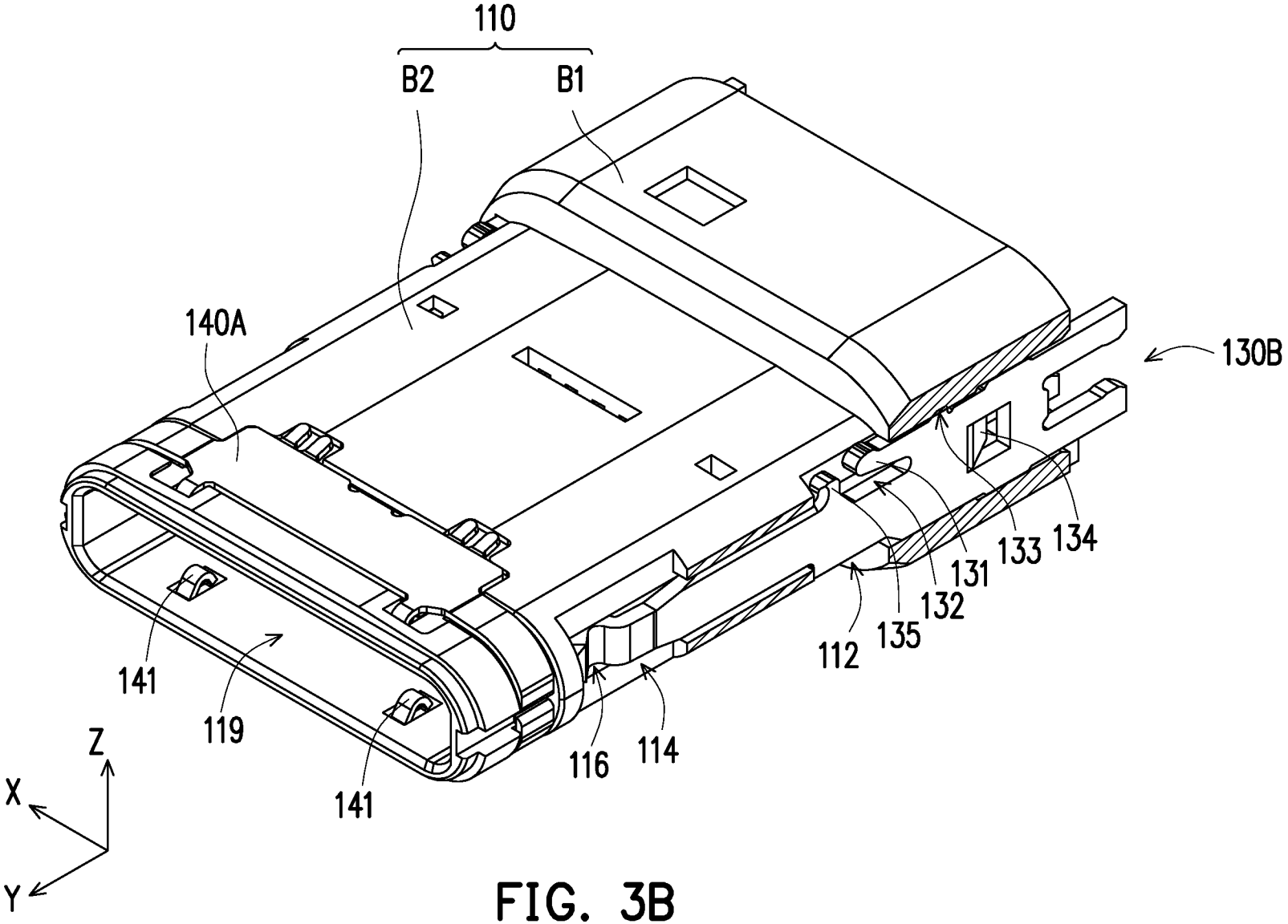
FIG. 3B is a partial cross-sectional diagram illustrating the plug electrical connector of FIG. 3A.

FIG. 3A is a schematic diagram illustrating part of components of the plug electrical connector of FIG. 1. FIG. 3B is a partial cross-sectional diagram illustrating the plug electrical connector of FIG. 3A. Here, the shielding shell 150 is not shown so that structural correspondences between the insulator 110 and the pair of side-latches 130A, 130B can be clearly recognized. Referring to both FIG. 3A and FIG. 3B and comparing FIG. 2, in the instant embodiment, the insulator 110 has a first notch 112 and a second notch 114, and the pair of side-latches 130A, 130B respectively include a protrusion 131, such that when the pair of side-latches 130A, 130B are inserted into the insulator 110, the protrusion 131 is exposed from the first notch 112 along a third axis (Z-axis) and thereby structurally leans against the shielding shell 150 when the shielding shell 150 is assembled with the insulator 110. In the instant embodiment, when the shielding shell 150 covers the insulator 110, a buckle portion 151 (which is formed, for example, by stamping and bending the shielding shell 150) of the shielding shell 150 buckles with a recess 113 of the insulator 110 to provide holding effect for the two.

Referring to FIG. 1 again, in the instant embodiment, the terminal set 120 and the pair of side-latches 130A, 130B of the plug electrical connector 100 are adapted to be soldered to an electronic member 200 and electrically connected to a grounding end G1 of the electronic member 200. Therefore, the pair of side-latches 130A, 130B and grounding terminals A1, A2 in the terminal set 120 can be electrically grounded. Namely, the effect of common ground is achieved through the electronic member 200. Meanwhile, since the shielding shell 150 is electrically connected with the pair of side-latches 130A, 130B through the protrusion 131, the effect of common ground effect of the shielding shell 150 can be further achieved. Accordingly, while the plug electrical connector 100 achieves electromagnetic shielding effect through the shielding shell 150, a shielding current generated therefrom can be discharged due to the foregoing grounding state, and better electrical protection and use effects are thereby provided for the plug electrical connector 100. Here, the form of the electronic member 200 is not limited and may be a circuit board or a cable.

Figure 4:
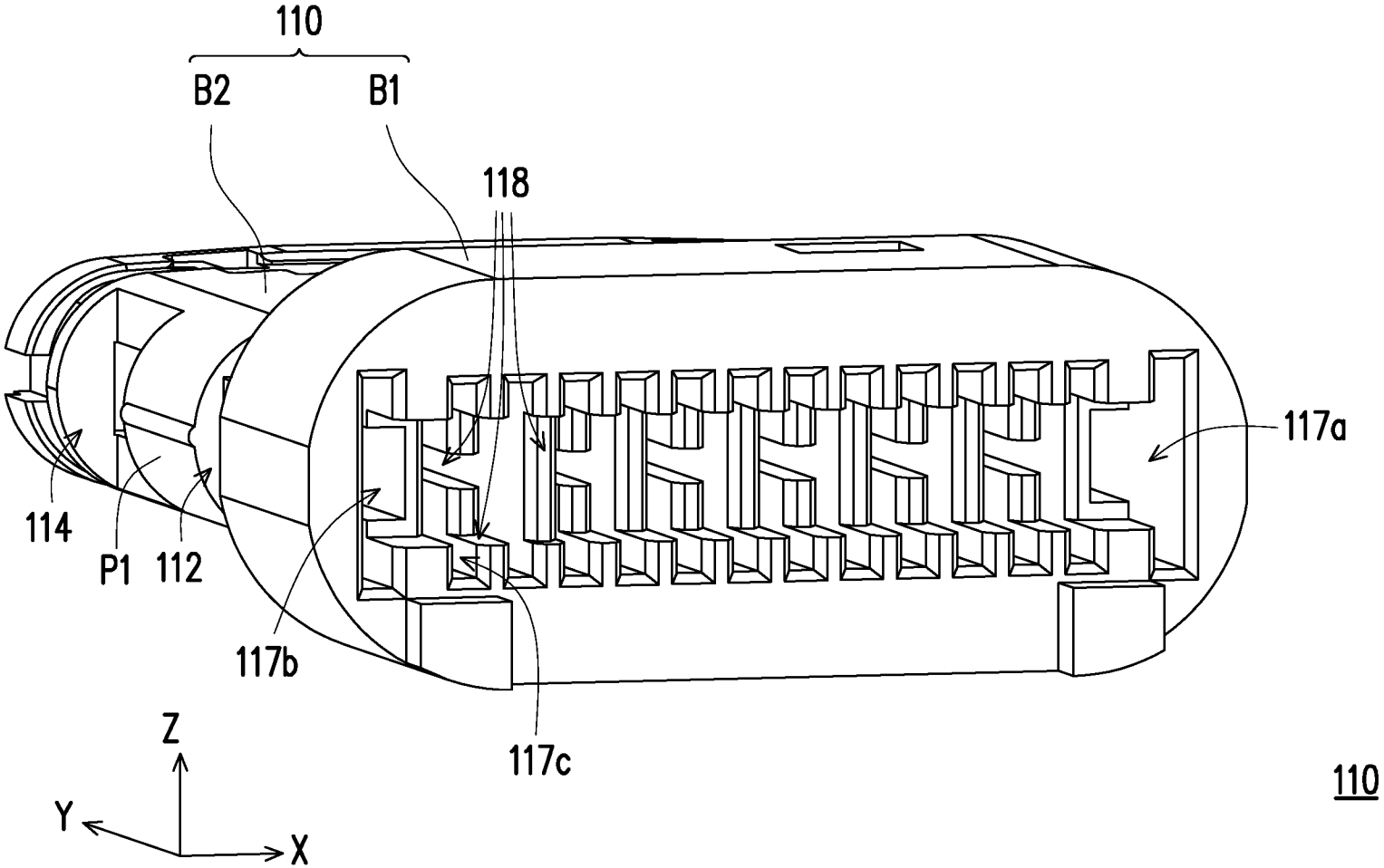
FIG. 4 illustrates an insulator of the plug electrical connector of FIG. 2 from another angle of view.

FIG. 4 illustrates the insulator of the plug electrical connector of FIG. 2 from another angle of view. Referring to FIG. 2 to FIG. 4 at the same time, specifically, the insulator 110 of the instant embodiment is formed of plastic by injection molding and has a pair of first slots 117*a*, 117*b* and a plurality of second slots 117*c* (only one second slot 117*c* is labeled in FIG. 4 as an example). The first slots 117*a*, 117*b* and the second slots 117*c* are arranged along the same axis, and the second slots 117*c* are located between the first slots 117*a*, 117*b*. Here, the first slots 117*a*, 117*b* are configured to accommodate the pair of side-latches 130A, 130B, and the second slots 117*c* are configured to accommodate the terminals of the terminal set 120. The slots all extend along Y-axis. Namely, the insulator 110 is first formed by injection molding, and the pair of side-latches 130A, 130B and the terminal set 120 are then inserted therein one by one. The first slot 117*a* is substantially connected with the first notch 112 of the insulator 110 (which is also the case for the first slot 117*b* on the other side). However, the instant embodiment does not limit the means for combining the insulator 110, the terminal set 120, and the pair of side-latches 130A, 130B. In another unillustrated embodiment, the components may also be manufactured in one single process by in-mold injection. Namely, upon being formed of plastic by an injection molding technique, the insulator 110 covers the pair of side-latches 130A, 130B and the terminal set 120 to form an integral structure. Referring to FIG. 2 again, the pair of side-latches 130A, 130B further respectively include a stop protrusion 134 to stop the flowing plastic when injecting plastic for forming the insulator 110 and to enhance a combination strength with the insulator 110.

Moreover, the insulator 110 is further divided into a base portion B1 and a butting portion B2. The shielding shell 150 covers the insulator 110 along Y-axis and covers all of the butting portion B2 and part of the base portion B1, wherein the butting portion B2 is configured to be connected with a receptacle electrical connector. The butting portion B2 extends from the base portion B1 along Y-axis, the terminal set 120 and the pair of side-latches 130A, 130B are assembled at the base portion B1 and extend towards the butting portion B2, and the pair of first notches 112 are located on two opposite sides of the butting portion B2 along X-axis.

In addition, in another unillustrated embodiment, since the terminal set is constituted by different upper and lower terminal sets that are aligned, the insulator may also be divided into vertically assembled upper and lower parts corresponding to the upper and lower terminal sets. Namely, the different terminal sets are respectively covered by different parts formed of plastic by injection molding, and then the upper and lower parts, along with the upper and lower terminal sets covered therein, are assembled to form the complete insulator and terminal set. In this state, the pair of side-latches may also be correspondingly divided into upper and lower locking portions covered by the upper and lower parts, or may be directly formed in the upper part or the lower part.

Referring to FIG. 2, FIG. 3A, and FIG. 3B again, the pair of side-latches 130A, 130B respectively include a holding segment L1 and a leaning segment L2, wherein the holding segment L1 is inserted into the first slots 117*a*, 117*b* and is assembled with the insulator 110. The pair of side-latches 130A, 130B respectively further include an engaging structure 133 located on the holding segment L1 for enhancing the combination strength at the first slots 117*a*, 117*b* of the insulator 110. Moreover, the protrusion 131 is located on the leaning segment L2 and is exposed out of the insulator 110 from the first notch 112 after penetrating through the first slots 117*a*, 117*b*. Specifically, due to the presence of a hollow portion 132, the protrusion 131 of each of the pair of side-latches 130A, 130B has elasticity, so that it can rebound at the first notch 112 after being pressed and deformed when penetrating through the first slots 117*a*, 117*b*, and thereby successfully structurally lean against an inner edge 152 of the shielding shell 150. Meanwhile, the stop protrusion 134 for stopping the flowing plastic is located on the holding segment L2, and the engaging structure 133 may also enhance the combination strength between the pair of side-latches 130A, 130B and the insulator 110 when the insulator 110 and the pair of side-latches 130A, 130B are manufactured in one single process. Moreover, the pair of side-latches 130A, 130B further include a stop portion 135 close to the protrusion 131. The stop portion 135 is located on the leaning segment L2 and is exposed from the first notch 112 to interfere with the insulator 110 (as shown in FIG. 3A) and provide positioning effect when the pair of side-latches 130A, 130B are inserted into the insulator 110.

More specifically, the pair of side-latches 130A, 130B of the instant embodiment are plate-shaped structures. A primary surface M1 of the plate-shaped structure is parallel to a plane (Y-Z plane) formed by the second axis (Y-axis) and the third axis (Z-axis). The protrusion 131 is regarded as extending from a side edge of the plate-shaped structure, and the pair of side-latches 130A, 130B further have the hollow portion 132, such that the protrusion 131 hangs from the side edge along the third axis (Z-axis) and is deformable along Z-axis. In the instant embodiment, an extending direction of the protrusion 131 is tilted from Z-axis.

Moreover, the pair of side-latches 130A, 130B respectively further include a locking segment L3. The leaning segment L2 is substantially located between the locking segment L3 and the holding segment L1, and, as shown in FIG. 2, the locking segment L3 includes a bending structure. Corresponding to the pair of side-latches 130A, 130B, the insulator 110 further includes the second notch 114, a groove 116, and a connection portion P1 respectively disposed on the butting portion B2. The connection portion P1 is respectively located on the two opposite sides of the butting portion B2 along X-axis, the second notch 114 is respectively located on the two opposite sides of the butting portion B2 along X-axis, and the first notch 112 and the second notch 114 disposed along Y-axis are separated from each other by the connection portion P1. When the pair of side-latches 130A, 130B are inserted into the insulator 110, the locking segment L3 is exposed from the second notch 114 and meanwhile penetrates through the groove 116 of the insulator 110 and extends towards internal space 119 of the insulator 110. Accordingly, when the plug electrical connector 100 of the instant embodiment is connected with the receptacle electrical connector (not illustrated), the pair of pair of side-latches 130A, 130B clip a mid-plate of the receptacle electrical connector through the locking segment L3 to allow the receptacle electrical connector to make ground connections to improve Electromagnetic Compatibility (EMC), wherein the second notch 114 provide room for deformation when the locking segment L3 is bent.

Referring to FIG. 2, FIG. 3A, and FIG. 3B again, in the instant embodiment, the plug electrical connector 100 further includes a pair of Electromagnetic Compatibility (EMC) shielding sheets 140A, 140B, each of which includes a locking portion 142 to correspond to a recess 115 of the insulator 110 to assemble the EMC shielding sheets 140A, 140B to the insulator 110 as upper and lower configurations. Moreover, each of the EMC shielding sheets 140A, 140B further includes a spring portion 141, which penetrates through an opening 111 of the insulator 110 and protrudes into the internal space 119 of the insulator 110 when the EMC shielding sheets 140A, 140B are assembled to the insulator 110. The spring portion 141 is configured to contact a metallic sheet of a tongue portion of the receptacle electrical connector when the plug electrical connector 100 is mated with the receptacle electrical connector. Meanwhile, as the EMC shielding sheets 140A, 140B further lean against the shielding shell 150 through a protrusion 143, a state where the pair of side-latches 130A, 130B, the shielding shell 150, the EMC shielding sheets 140A, 140B, the grounding terminals A1, A2 of the terminal set 120, and the grounding portion of the receptacle electrical connector are used to create a common ground.

Referring to FIG. 4 again, in the process of forming the insulator 110 of plastic by injection molding in the instant embodiment, to prevent contour bending of the formed first slots 117*a*, 117*b* and the second slots 117*c*, which is unfavorable to an insertion step of the terminal set 120 and the pair of side-latches 130A, 130B, a plurality of third notches 118 structurally exist in or between the first slots 117*a*, 117*b* and the second slots 117*c*. As shown in FIG. 4., ends of the first slots 117*a*, 117*b* and the second slots 117*c* are interconnected. In other words, pins in a mold of the insulator 110 for forming the slots have an interconnected structure to maintain collimatedness in the injection molding process. For this reason, the third notches 118 at the structural ends of the first slots 117*a*, 117*b* and the second slots 117*c* are formed.

Figure 5:
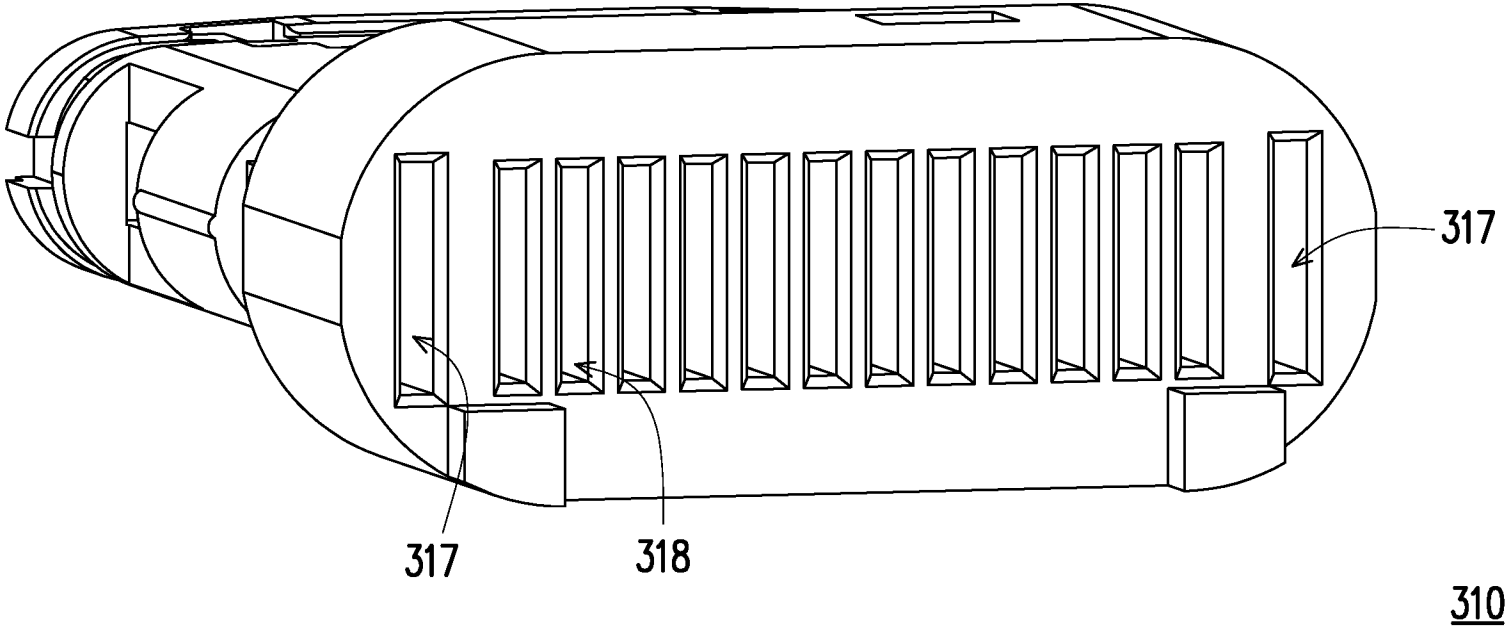
FIG. 5 is a schematic diagram illustrating an insulator of a plug electrical connector according to another embodiment.

FIG. 5 is a schematic diagram illustrating an insulator of a plug electrical connector according to another embodiment. The difference from the foregoing embodiment lies in that when the pins for the insulator 110 exhibit a certain degree of collimatedness, an insulating material is frilly filled between first slots 317 and second slots 318, and the first slots 317 and the second slots 318 are independent from each other. In other words, in the process of forming the first slots 317 and the second slots 318, the pins in the mold are substantially independent from each other.

Figure 6:
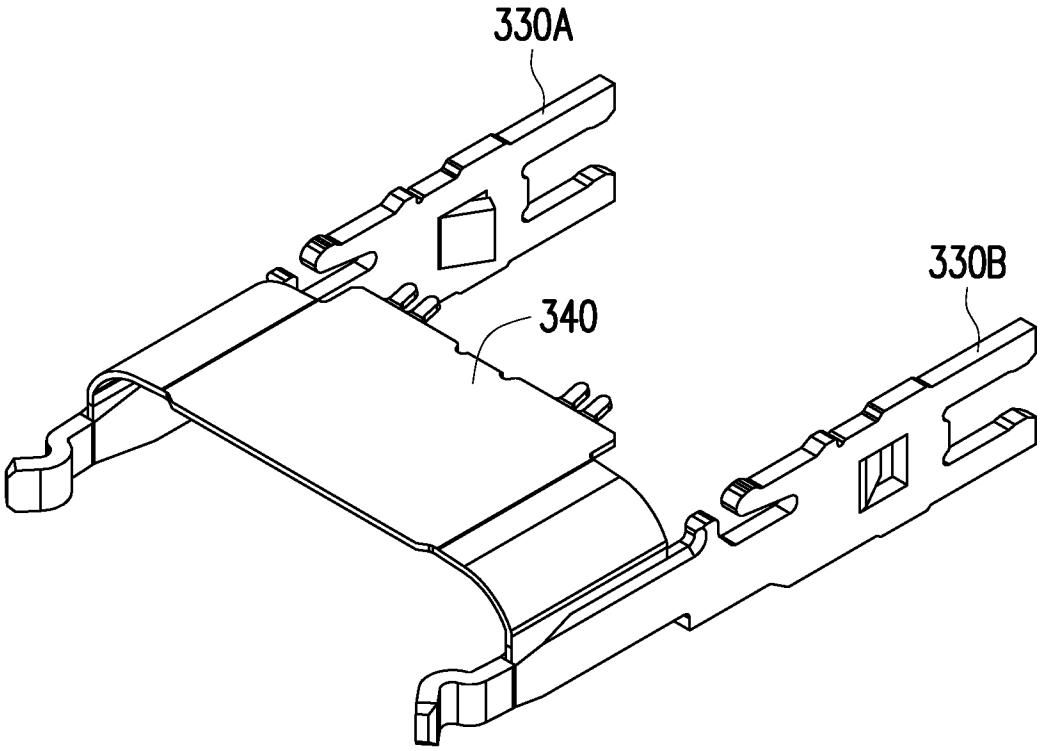
FIG. 6 is a schematic diagram illustrating EMC shielding sheets of a plug electrical connector according to another embodiment.

FIG. 6 is a schematic diagram illustrating EMC shielding sheets of a plug electrical connector according to another embodiment. The difference from the foregoing embodiment lies in that EMC shielding sheets 340 and pair of side-latches 330A, 330B of the instant embodiment are an integral structure. Namely, the EMC shielding sheets 340 and the pair of side-latches 330A, 330B are formed by stamping and bending one single conductive sheet. Meanwhile, this configuration means that the pair of side-latches 330A, 330B can be regarded as a single-piece member.

In summary of the above, in the plug electrical connector of the foregoing embodiments of the invention, the pair of side-latches are configured to structurally lean against the shielding shell to thereby achieve electrical connection between the two. Accordingly, when the pair of side-latches and the grounding terminals of an electronic member are electrically grounded through the electronic member, it means that the shielding shell is also electrically grounded, and such configuration contributes to discharging the shielding current on the shielding shell and enhancing the electromagnetic shielding effect.

Meanwhile, the EMC shielding sheets disposed on the insulator not only lean against the shielding shell through the protrusion, but a portion of them also penetrates through the insulator and extends into the internal space of the insulator, such that the portion can clip the tongue portion and the grounding portion of the receptacle electrical connector when the plug electrical connector and the receptacle electrical connector are connected with each other. Due to this configuration, the effect of collective grounding of the plug electrical connector and the receptacle electrical connector can thereby be achieved.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A plug electrical connector comprising:

an insulator;

a pair of side-latches disposed in the insulator;

a terminal set disposed in the insulator, wherein the pair of side-latches are located on two side of the terminal set, and the pair of side-latches and a plurality of terminals of the terminal set are arranged along a first axis and each of the side-latches and the plurality of terminals extends along a second axis; and a shielding shell covering the insulator along the second axis, wherein each side-latch comprises a protrusion exposed out of the insulator along a third axis and structurally leaning against an inner edge of the shielding shell, such that the shielding shell is electrically connected with the pair of side-latches, wherein the first axis, the second axis, and the third axis are orthogonal to each other;

and wherein the side-latch is divided into a holding segment, a leaning segment, and a locking segment along the second axis, wherein the leaning segment is located between the holding segment and the locking segment, the holding segment is assembled in the insulator, the protrusion is located on the leaning segment, and the locking segment penetrates through the insulator and extends towards internal space in the insulator.

2. The plug electrical connector according to claim 1, wherein the pair of side-latches and the terminal set are respectively soldered to an electronic member, and the pair of side-latches and at least one grounding terminal of the terminal set form electrical grounding through the electronic member.

3. The plug electrical connector according to claim 1, wherein the side-latch is a plate-shaped structure, and the protrusion extends from a side edge of the plate-shaped structure, wherein the side-latch has a hollow portion, such that the protrusion hangs from the side edge and is deformable along the third axis, and an extension direction of the protrusion is tilted from the third axis.

4. The plug electrical connector according to claim 3, wherein a primary surface of the plate-shaped structure is parallel to a plane formed by the second axis and the third axis.

5. The plug electrical connector according to claim 4, wherein the insulator has at least one slot to accommodate the side-latch, and the side-latch further comprises a stop protrusion protruding from the primary surface of the plate-shaped structure and leaning against an inner wall of the slot to close the slot.

6. The plug electrical connector according to claim 3, wherein the side-latch further comprises an engaging structure located on the side edge, and the side-latch is assembled to the insulator through the engaging structure.

7. The plug electrical connector according to claim 1, which is a USB type C plug electrical connector and is adapted to be connected with a receptacle electrical connector, wherein the pair of side-latches are arranged on two opposite sides of the terminal set, and a mid-plate of the receptacle electrical connector is adapted to be locked by the pair of side-latches.

8. The plug electrical connector according to claim 1, further comprising:

a shielding sheet disposed outside the insulator, wherein a portion of the shielding sheet penetrates through the insulator and protrudes into an internal space of the insulator.

9. The plug electrical connector according to claim 8, wherein the shielding sheet and the pair of side-latches are an integral structure.

10. A plug electrical connector comprising:

an insulator comprising a pair of first slots and a plurality of second slots arranged along a first axis and extending along a second axis, wherein the second slots are located between the pair of first slots;

a terminal set comprising a plurality of terminals respectively disposed in the second slots;

a pair of side-latches respectively disposed in the pair of first slots; and a shielding shell covering the insulator along the second axis, wherein the insulator has a pair of first notches respectively connected with the pair of first slots, and the pair of first notches respectively expose a portion of the pair of side-latches along a third axis, wherein the first axis, the second axis, and the third axis are orthogonal to each other;

wherein each of the pair of side-latches comprises a holding segment and a leaning segment, wherein the holding segment is disposed in the first slot, and the leaning segment is located in the first notch and structurally leans against the shielding shell, such that the pair of side-latches are electrically connected with the shielding shell;

and wherein each of the pair of side-latches further comprises a locking segment, wherein the leaning segment is located between the holding segment and the locking segment, and the pair of locking segments penetrate through the insulator and extend towards an internal space in the insulator.

11. The plug electrical connector according to claim 10, wherein the insulator comprises a base portion and a butting portion, wherein the butting portion extends from the base portion along the second axis, the terminal set and the pair of side-latches are assembled to the base portion and extend towards the butting portion, and the pair of first notches are located on two opposite sides of the butting portion along the first axis.

12. The plug electrical connector according to claim 11, wherein the insulator further comprises a pair of connection portions and a pair of second notches disposed on the butting portions, the pair of connection portions are respectively located on the two opposite sides of the butting portion along the first axis, the pair of second notches are respectively located on the two opposite sides of the butting portion along the first axis, and the first notches and the second notches disposed along the second axis are separated from each other by the connection portions.

13. The plug electrical connector according to claim 10, wherein each of the pair of side-latches comprises a protrusion located on the leaning segment and exposed from the first notch along the third axis, and the protrusion extends and leans against an inner edge of the shielding shell.

14. The plug electrical connector according to claim 10, wherein each of the pair of side-latches further comprises an engaging structure located on the holding segment, and each of the pair of side-latches is assembled to the first slot of the insulator through the engaging structure.

15. The plug electrical connector according to claim 10, wherein the pair of side-latches and the terminal set are respectively soldered to an electronic member, and the pair of side-latches and at least one grounding terminal of the terminal set are electrically grounded through the electronic member.

16. The plug electrical connector according to claim 10, which is a USB type C plug electrical connector and is adapted to be mated with a receptacle electrical connector, wherein the pair of side-latches are arranged on two opposite sides of the terminal set, and a mid-plate of the receptacle electrical connector is adapted to be locked by the pair of side-latches.

17. The plug electrical connector according to claim 16, further comprising:

a shielding sheet disposed outside the insulator, wherein a portion of the shielding sheet penetrates through the insulator and protrudes into an internal space of the insulator to lean against the receptacle electrical connector when the plug electrical connector and the receptacle electrical connector are connected with each other.

18. The plug electrical connector according to claim 17, wherein the shielding sheet and the pair of pair of side-latches are an integral structure, and the shielding sheet is connected between the pair of side-latches.

* * * * *